US008827251B2

(12) United States Patent
Kuo

(10) Patent No.: US 8,827,251 B2
(45) Date of Patent: Sep. 9, 2014

(54) HANDHELD CLAMPING TOOL

(71) Applicant: Tzu-Chi Kuo, Keelung (TW)

(72) Inventor: Tzu-Chi Kuo, Keelung (TW)

( * ) Notice: Subject to any disclaimer, the term of this patent is extended or adjusted under 35 U.S.C. 154(b) by 224 days.

(21) Appl. No.: 13/627,785

(22) Filed: Sep. 26, 2012

(65) Prior Publication Data

US 2013/0264759 A1 Oct. 10, 2013

Related U.S. Application Data

(63) Continuation-in-part of application No. 13/440,255, filed on Apr. 5, 2012.

(51) Int. Cl.
*B25B 5/06* (2006.01)

(52) U.S. Cl.
USPC ..... 269/6; 269/3; 269/95

(58) Field of Classification Search
USPC ..... 269/6, 3, 95, 166–171.5
See application file for complete search history.

(56) References Cited

U.S. PATENT DOCUMENTS

| | | | | |
|---|---|---|---|---|
| 7,322,572 | B1 * | 1/2008 | Yang | 269/6 |
| 8,366,089 | B2 * | 2/2013 | Chen | 269/147 |
| 8,424,856 | B2 * | 4/2013 | Lombardi et al. | 269/6 |
| 2004/0195746 | A1 * | 10/2004 | Marks | 269/6 |
| 2006/0043660 | A1 * | 3/2006 | Ping | 269/6 |
| 2006/0131802 | A1 * | 6/2006 | Fuller et al. | 269/6 |
| 2007/0069438 | A1 * | 3/2007 | Rowlay et al. | 269/6 |

* cited by examiner

*Primary Examiner* — Lee D Wilson
*Assistant Examiner* — Henry Hong
(74) *Attorney, Agent, or Firm* — Pai Patent & Trademark Law Firm; Chao-Chang David Pai

(57) ABSTRACT

A handheld clamping tool includes a sliding bar, a bracket selectively and detachably coupled to one of two opposite ends of the sliding bar and providing a first jaw, a handle holder affixed to the sliding bar and providing a second jaw, a driving handle operable to move the bracket relative to the handle holder, and a control knob including a male knob member and a female knob member coupled together in a horizontal bottom hole of the bracket, a pin affixed to the female knob member and movable with the female knob member in and out of a lock hole at one end of the sliding bar to lock/unlock the bracket and the sliding bar, and a compression spring mounted between the male knob member and the bracket to support the male knob member in the locking position where the pin is inserted through the lock hole.

7 Claims, 7 Drawing Sheets

HANDHELD CLAMPING TOOL

BACKGROUND OF THE INVENTION (a) Field of the Invention

The present invention relates to a handheld clamping tool and more particularly, to a simple design of handheld clamping tool, which is adjustable between two modes for clamping application or expansion application.

(b) Description of the Prior Art

Conventional handheld clamping tools are generally designed for clamping or expanding an object. A handheld clamping tool is known comprising a bracket, a sliding bar, a handle holder, a driving handle, a first jaw and a second jaw. The first jaw is mounted at the top side of the bracket. The second jaw is mounted at the top side of the handle holder. When continuously pressing the driving handle, the first and second jaws will be moved relative to each other for clamping or expansion application. Taiwan Patent M344953 (equivalent to China Patent 200810006515.5 or U.S. Pat. No. 7,513,492) discloses a similar design, entitled "Hand held quick-clamping device".

According to conventional designs, the mounting position between the bracket and the sliding bar can be adjusted to have the first jaw and the second jaw be disposed facing each other for clamping application, or in reversed directions for expansion application. When the two jaws are arranged facing each other, the handheld clamping tool can be used to clamp an object. On the contrary, when the two jaws are arranged in reversed directions, the handheld clamping tool can be used to expand an object. Thus, the mounting position between the bracket and the sliding bar must be properly changed to fit different application requirements, i.e., the bracket can be located at one end of the sliding bar for clamping application, or at the other end of the sliding bar for expansion application. Thus, the user may have to frequently detach the bracket from one end of the sliding bar and then attach the bracket to the other end of the sliding bar.

According to conventional designs, a lock screw is inserted through the bracket and a lock hole at one end of the sliding bar and then screwed up with a nut to lock the bracket to the sliding bar. When going to change the operation mode of the handheld clamping tool, the user must remove the nub and the lock screw from the bracket and the sliding bar, and then insert the lock screw through the bracket and a second lock hole at the other end of the sliding bar and then thread the nut onto the lock screw to lock the bracket and the sliding bar. This operation procedure is complicated, requiring much labor and time.

U.S. Pat. No. 6,945,523 discloses a clamping tool comprising a displaceable and repositionable fixed clamping jaw. According to this design, a push button is provided for operation control, and a U-shaped catch member having a shorter U-leg and a longer U-leg is used to carry the push button. This structural design is complicated. Installation of the component parts is inconvenient and complicated.

SUMMARY OF THE INVENTION

The present invention has been accomplished under the circumstances in view. It is one object of the present invention to provide a handheld clamping tool, which is adjustable between two modes for clamping application or expansion application.

To achieve this and other objects of the present invention, a handheld clamping tool comprises a sliding bar comprising two lock holes respectively disposed near two opposite ends thereof, a bracket selectively and detachably coupled to one of the two opposite ends of the sliding bar in one of two reversed directions and providing a first jaw, a handle holder affixed to the sliding bar and providing a second jaw, a driving handle mounted at the handle holder and coupled to the sliding bar and operable to move the bracket relative to the handle holder, and a control knob for locking the bracket to the sliding bar in one of the said two reversed directions. The control knob comprises a male knob member and a female knob member coupled together in a horizontal bottom hole of the bracket, a pin affixed to the female knob member and movable with the female knob member in and out of a lock hole at one end of the sliding bar to lock/unlock the bracket and the sliding bar, and a compression spring mounted between the male knob member and the bracket to support the male knob member in the locking position where the pin is inserted through the lock hole.

DETAILED DESCRIPTION OF THE PREFERRED EMBODIMENTS

Figure 1:
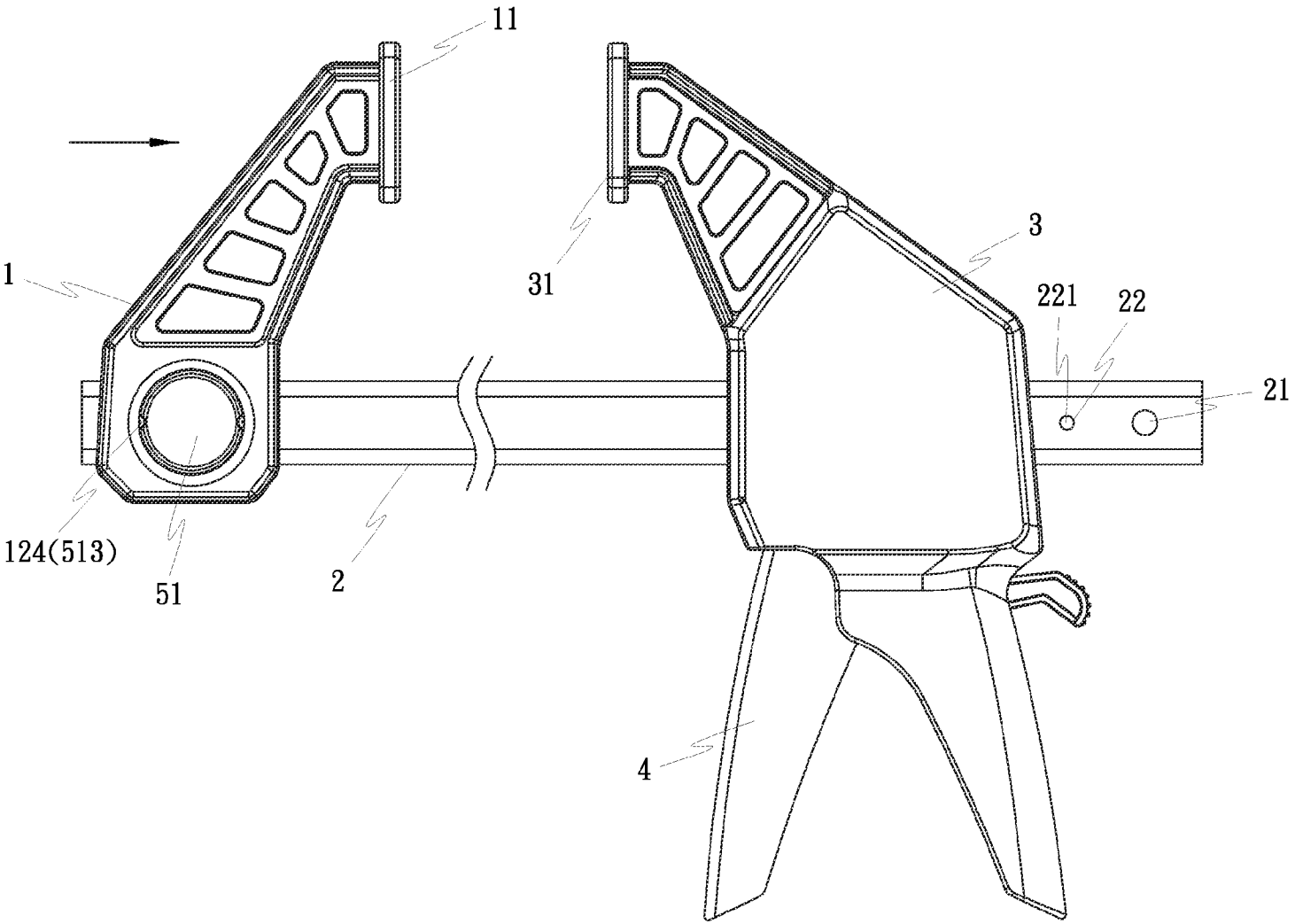
FIG. 1 is a schematic drawing illustrating the arrangement of a handheld clamping tool in accordance with the present invention.
Figure 2:
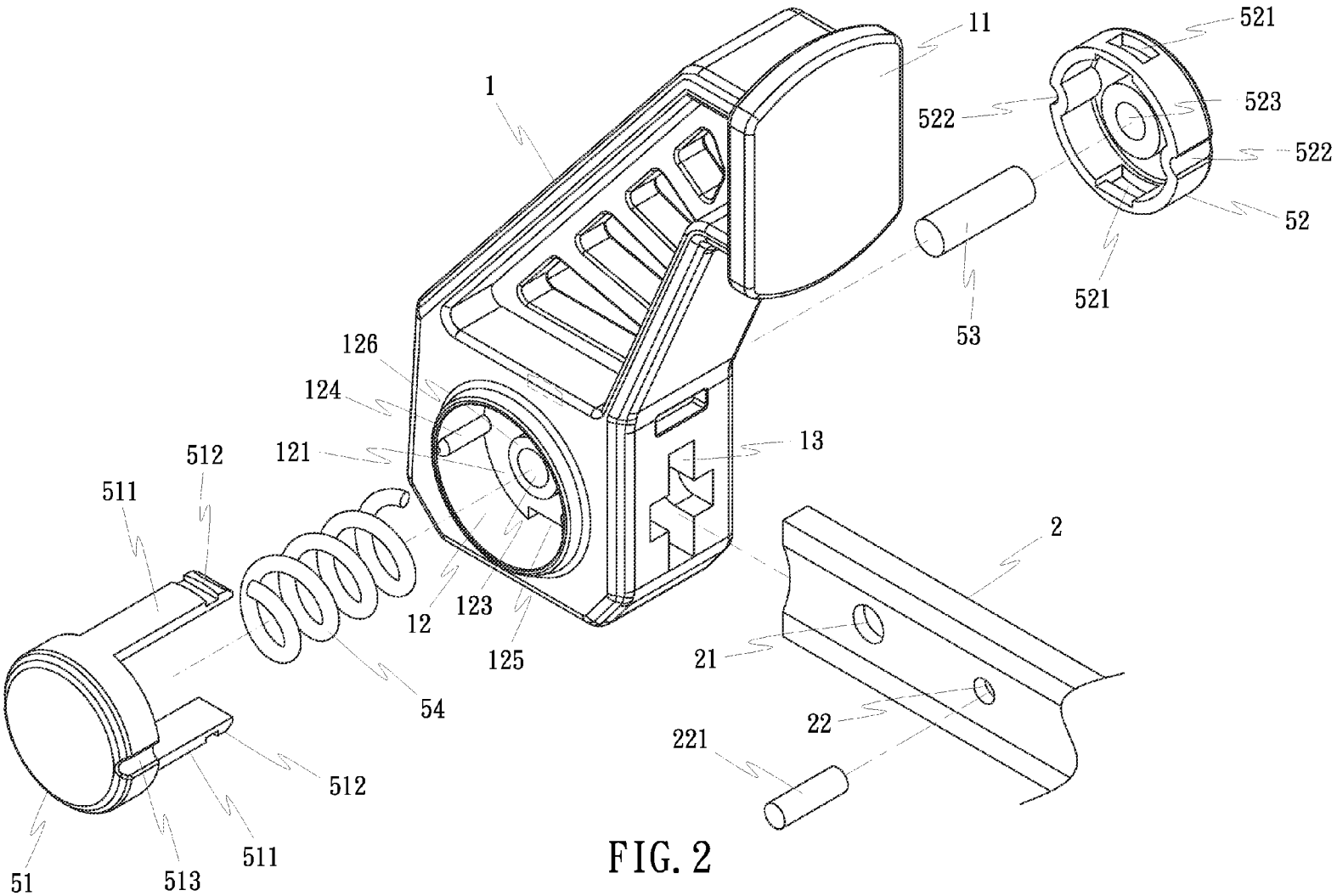
FIG. 2 is an exploded view of the handheld clamping tool in accordance with the present invention.
Figure 3:
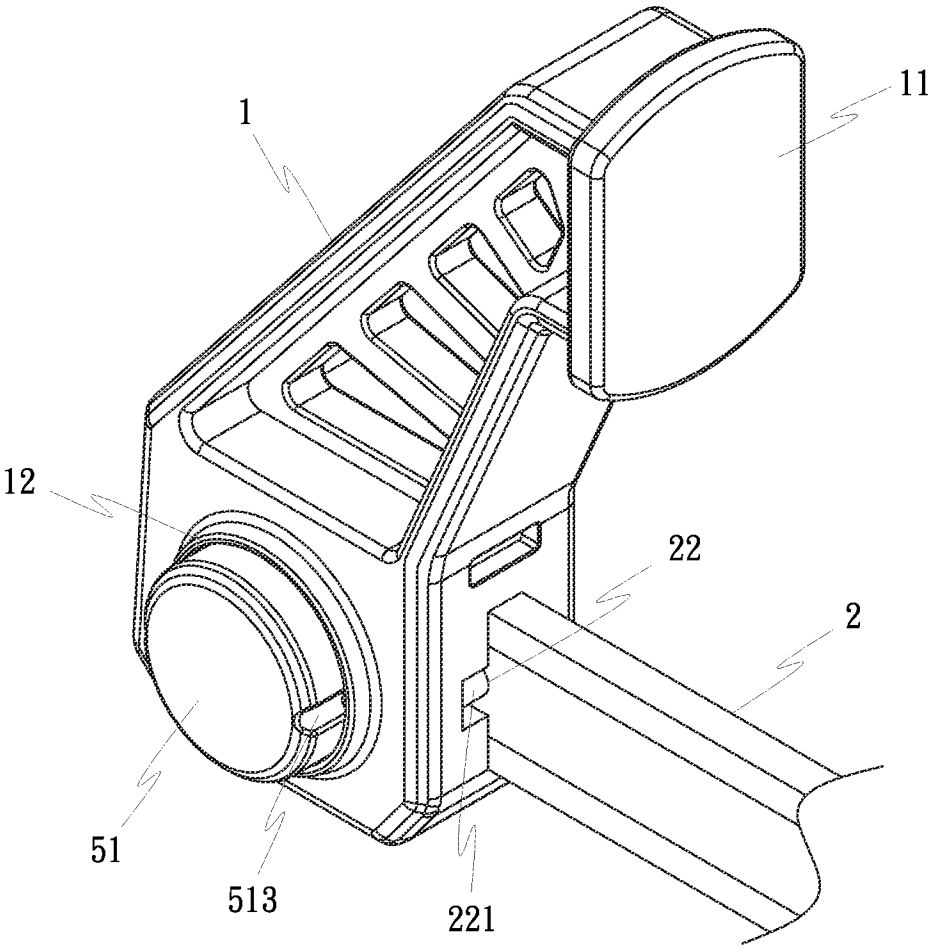
FIG. 3 is an elevational view of a part of the present invention, illustrating the bracket and the sliding bar fastened together.
Figure 4:
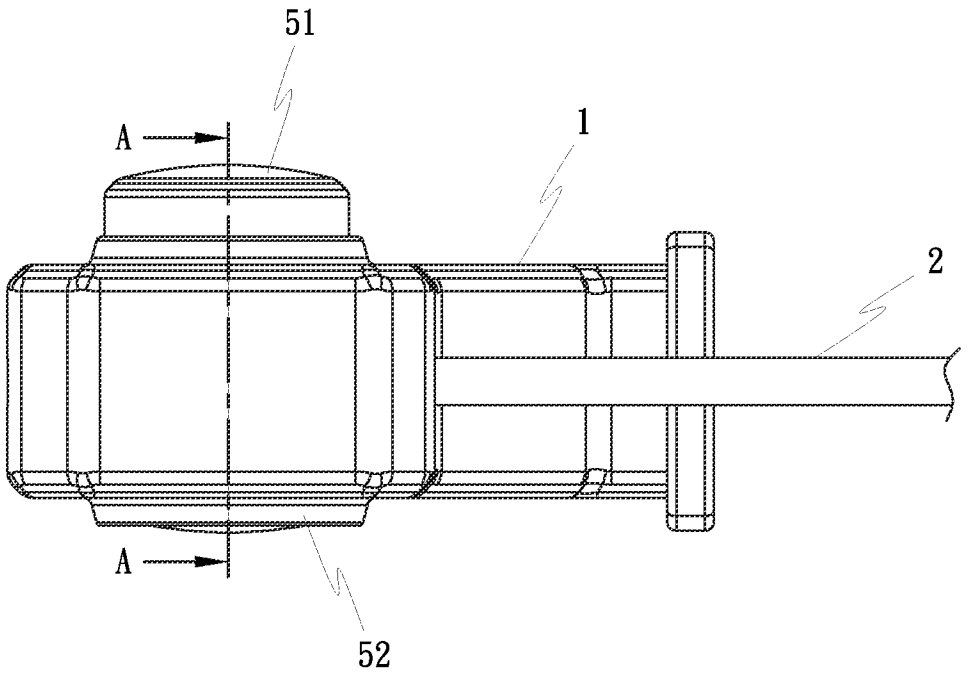
FIG. 4 is a bottom view of FIG. 3.

Referring to FIG. 1, a handheld clamping tool in accordance with the present invention is shown. The handheld clamping tool comprises a bracket 1, a sliding bar 2, a handle holder 3, and a driving handle 4.

The bracket 1 is fastened to one end of the sliding bar 2, providing a first jaw 11.

The sliding bar 1 is inserted through the bracket 1, the handle holder 3 and the driving handle 4, comprising two lock holes 21 respectively disposed near two opposite ends thereof, two locating holes 22 respectively disposed adjacent to the lock holes 21 at an inner side for the insertion of a pin 53, and two stop rods 221 respectively mounted in the locating holes 22 for stopping against the bracket 1 and the handle holder 3 respectively.

The handle holder 3 is affixed to the sliding bar 2, providing a second jaw 31.

The driving handle 4 is mounted at the handle holder 3 and coupled to the sliding bar 2, and operable to move the bracket 1 toward the handle holder 3 (see the arrowhead direction shown in FIG. 1) and to further provide a clamping function.

In the present invention, the aforesaid sliding bar 2, handle holder 3, driving handle 4 and first and second jaws 11;31 are known component parts. The main feature of the present invention is at the structural design of the bracket 1. As illustrated in FIGS. 2-5, the bracket 1 comprises a horizontal bottom hole 12 extending through two opposite lateral sides thereof in X-axis direction, two baffle walls 121;122 disposed in the horizontal bottom hole 12 in a parallel manner, a pinhole 123 extending through the center of each of the baffle walls 121;122 in the horizontal bottom hole 12 in X-axis direction, a plurality of elongated guide ribs 124 protruded from the inner perimeter of the horizontal bottom hole 12 and respectively outwardly extended from the baffle walls 121; 122 in X-axis direction, two opposing through holes 125 respectively cut through each of the two baffle walls 121;122 in X-axis direction, an insertion slot 13 extending through opposite front and back sides thereof in Y-axis direction across the space in the horizontal bottom hole 12 between the baffle walls 121;122 for the insertion of the sliding bar 2, and a control knob formed of a male knob member 51, a female knob member 52, a pin 53 and a compression spring 54 and mounted in the horizontal bottom hole 12.

The male knob member 51 is a cap member comprising two legs 511 axially and outwardly extended from the periphery thereof in a parallel manner and respectively terminating in a hook tip 512, and at least one elongated guide groove 513 located on the periphery thereof. The two legs 511 of the male knob member 5 are inserted from one lateral side of the bracket 1 through the through holes 125 in the horizontal bottom hole 12 to force the hook tips 512 into engagement with the female knob member 52. At this time, the at least one elongated guide groove 513 is respectively coupled to one respective elongated guide rib 124 in the horizontal bottom hole 12 of the bracket 1.

The female knob member 52 mates with the male knob member 51, comprising two hook holes 521 located at the periphery thereof at two opposite sides for receiving the hook tips 512 of the legs 511 of the male knob member 51, at least one elongated guide groove 522 located on the periphery thereof and coupled to one respective elongated guide rib 124 at an opposite side relative to the male knob member 51, and a plughole 523 axially located at the center of the inside wall thereof.

Figure 5:
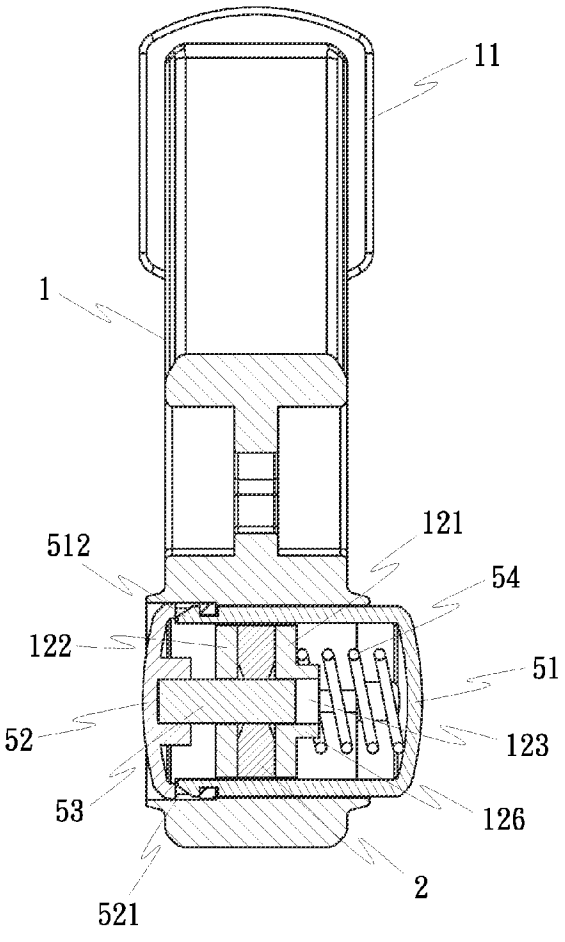
FIG. 5 is a sectional view taken along line A-A of FIG. 4 (where the pin is inserted through the lock hole of the sliding bar).

The pin 53 is tightly plugged into the plughole 523 of the female knob member 52 and insertable through the pinhole 123 and the lock hole 21 of the sliding bar 2 (see FIG. 5).

Figure 6:
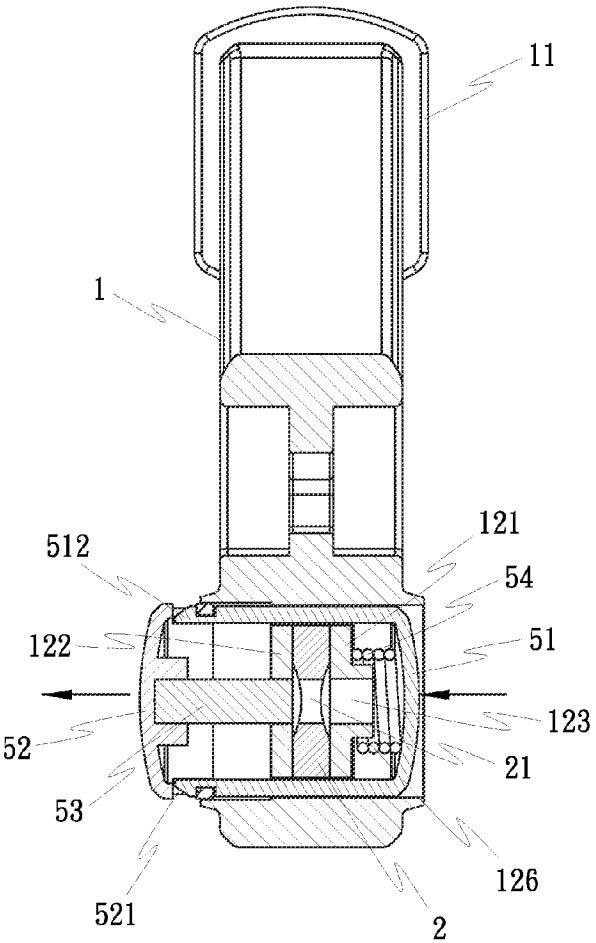
FIG. 6 corresponds to FIG. 5, illustrating the pin of the female knob member disengaged from the lock hole of the sliding bar.

The compression spring 54 is accommodated in the male knob member 51 between the two legs 511 and stopped between the inside wall of the male knob member 51 and one baffle wall 121 to impart a pressure to the male knob member 51 in direction away from the bracket 1. When the user presses the male knob member 51 to compress the compression spring 54 (see FIG. 6), the female knob member 52 will be pushed outwardly toward the outside of the bracket 1 to release the pin 53 from the respective lock hole 21 of the sliding bar 2, thereby unlocking the bracket 1.

During application, the make knob member 51 and the female knob member 52 are respectively inserted into the horizontal bottom hole 12 of the bracket 1 from two opposite lateral sides to insert the through the pinhole 123 and the lock hole 21 of the sliding bar 2 and to force the hook tips 512 of the legs 511 of the male knob member 51 into engagement with the hook holes 521 of the female knob member 52. At this time, the first jar 11 and the second jaw 31 are disposed facing each other for clamping application. On the contrary, when going to use the handheld clamping tool for expansion application, press the male knob member 51 to compress the compression spring 54 and to move the female knob member 52 outwardly toward the outside of the bracket 1, enabling the pin 53 to be carried by the female knob member 52 away from the respective lock hole 21 of the sliding bar 2. At this time, the user can remove the bracket 1 from one end of the sliding bar 2, and then attach the bracket 1 to the other end of the sliding bar 2 to have the bracket 1 to be locked to the other lock hole 21 of the sliding bar 2 and to hold the first jar 11 and the second jaw 31 in reversed directions for expansion application (see FIG. 7).

Referring to FIG. 4 again, the bracket 1 further comprises an annular flange 126 protruded from an outer surface of the baffle wall 121 around the pinhole 123 for supporting the compression spring 54 positively in position.

Figure 9:
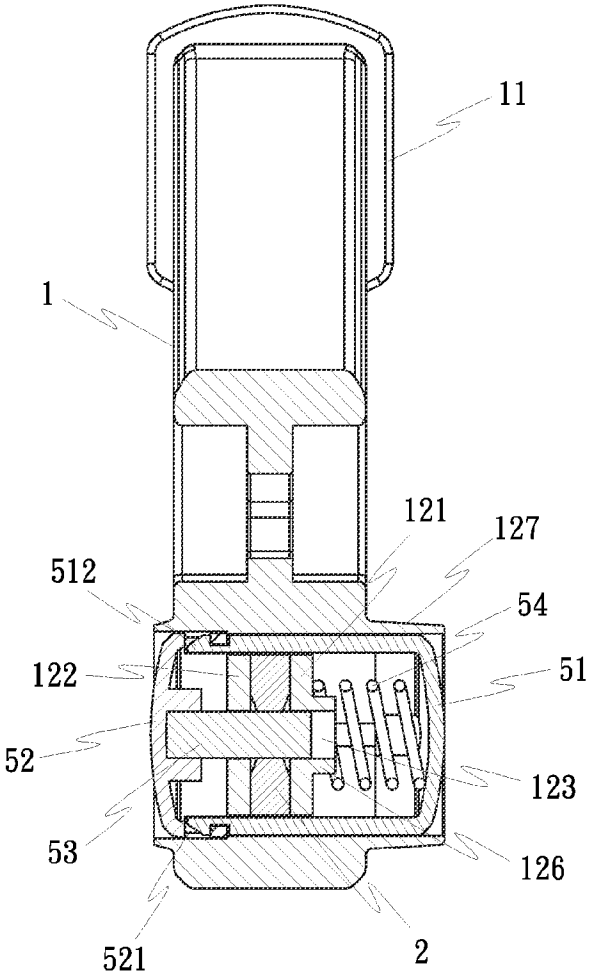
FIG. 9 is a schematic sectional view of the alternate form of the handheld clamping tool shown in FIG. 8.
Figure 8:
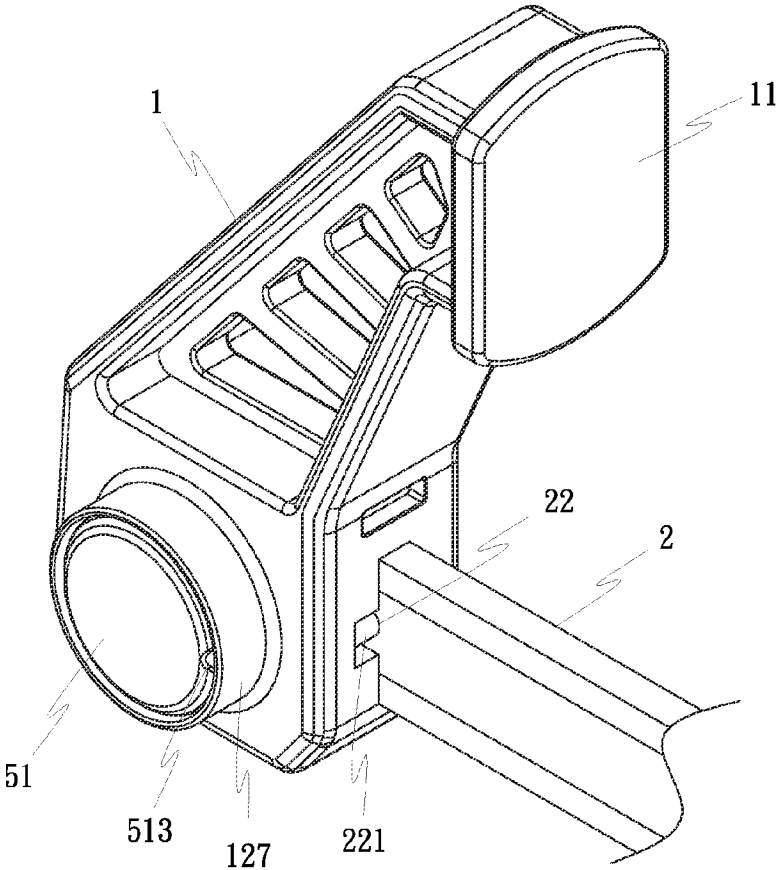
FIG. 8 is an elevational view of a part of an alternate form of the handheld clamping tool in accordance with the present invention.

FIGS. 8 and 9 illustrate an alternate form of the present invention. According to this alternate form, the bracket 1 further comprises a tubular protruding piece 127 protruding from one lateral side thereof around the horizontal bottom hole 12 to protect the male knob member 51 against accidental impact, preventing the male knob member 51 from being pressed accidentally by an external force to unlock the bracket 1 from the sliding bar 2.

Figure 7:
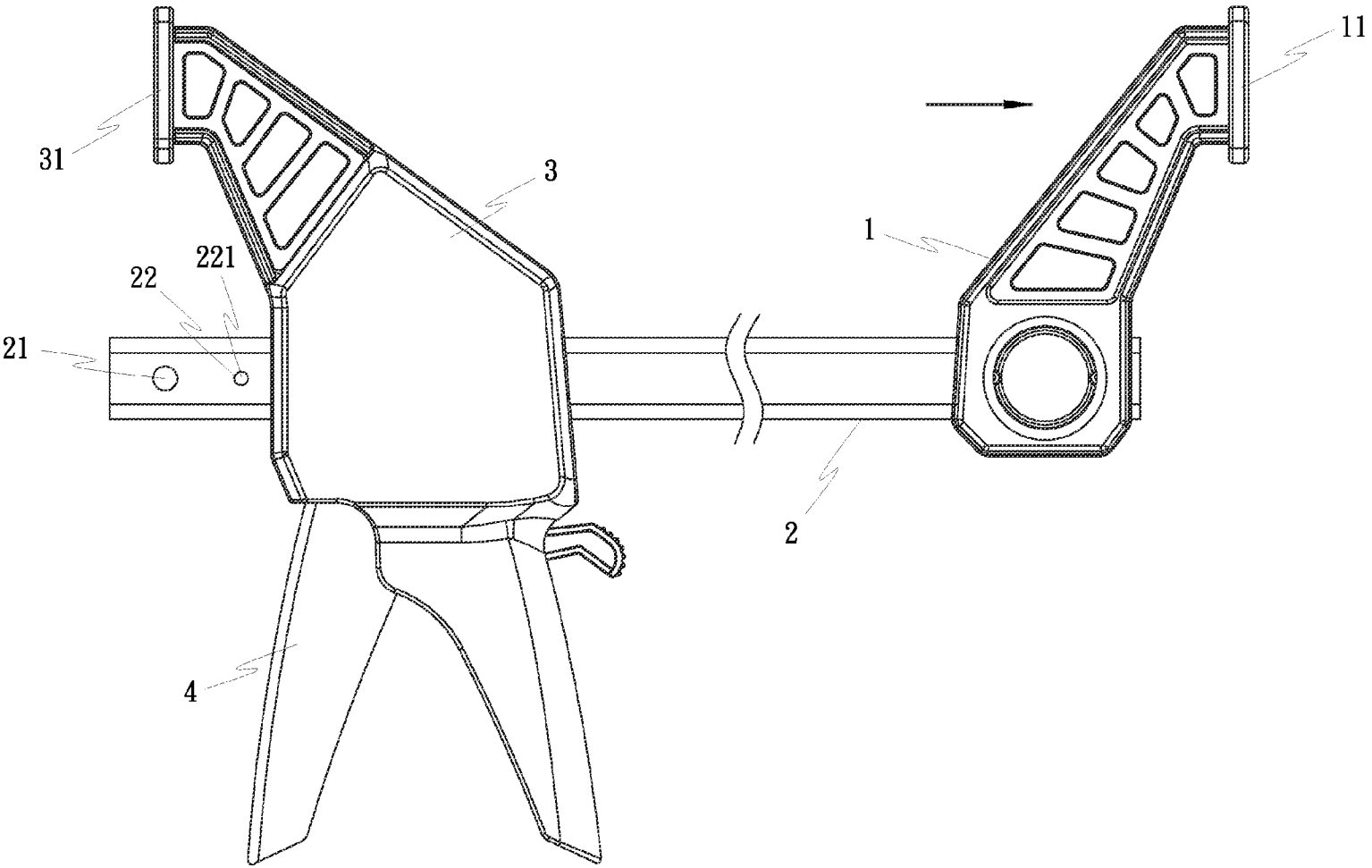
FIG. 7 is a schematic drawing of the present invention, illustrating the first jaw and the second jaw disposed in reversed direction for expansion application.

As stated above, subject to the design of the control knob of the bracket 1, the invention allows the handheld clamping tool to be alternatively set between a first mode shown in FIG. 1 for clamping application and a second mode shown in FIG. 7 for expansion application. The control knob has a simple structure can be mounted in or removed from the bracket 1 easily and conveniently. Therefore, the invention involves an inventive step.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A handheld clamping tool, comprising:

a sliding bar comprising two lock holes respectively disposed near two opposite ends thereof;

a bracket selectively and detachably coupled to one of the two opposite ends of said sliding bar, said bracket providing a first jaw;

a handle holder affixed to said sliding bar, said handle holder providing a second jaw;

a driving handle mounted at said handle holder and coupled to said sliding bar and operable to move said bracket relative to said handle holder; and a control knob for locking said bracket to one said lock hole of said sliding bar;

wherein:

said bracket comprises a horizontal bottom hole extending through two opposite lateral sides thereof;

said control knob comprises:

a male knob member shaped like a cap member comprising two legs axially and outwardly extended from the periphery thereof in a parallel manner and inserted through said horizontal bottom hole of said bracket and respectively terminating in a hook tip;

a female knob member mating with said male knob member, said female knob member comprising two hook holes located at the periphery thereof at two opposite sides and respectively engaged with said hook tips of said legs of said male knob member;

a pin affixed to said female knob member and movable with said female knob member in and out of one lock hole of said sliding bar to lock said bracket to said sliding bar or to unlock said bracket from said sliding bar; and a compression spring accommodated in said male knob member between said two legs and stopped between an inside wall of said male knob member and a part of said bracket in said horizontal bottom hole to impart a pressure to said male knob member in direction away from said bracket.

2. The handheld clamping tool as claimed in claim 1, wherein said bracket further comprises at least one elongated guide rib protruded from an inner periphery of said horizontal bottom hole; said male knob member comprises at least one elongated guide groove slidably coupled to said at least one elongated rib of said bracket.

3. The handheld clamping tool as claimed in claim 1, wherein said bracket further comprises at least one elongated guide rib protruded from an inner periphery of said horizontal bottom hole; said female knob member comprises at least one elongated guide groove slidably coupled to said at least one elongated rib of said bracket.

4. The handheld clamping tool as claimed in claim 1, wherein said female knob member comprises a plughole axially located at the center of the inside wall thereof; said pin of said control knob is tightly fastened to said plughole of said female knob member.

5. The handheld clamping tool as claimed in claim 1, wherein said bracket further comprises two baffle walls disposed in parallel in said horizontal bottom hole, a pinhole extending through the center of each said baffle wall for the passing of said pin of said control knob, and two through holes cut through each said baffle wall for the passing of said legs of said male knob member.

6. The handheld clamping tool as claimed in claim 1, wherein said bracket further comprises an annular flange protruded from an outer surface of each baffle wall around said pinhole.

7. The handheld clamping tool as claimed in claim 1, wherein said bracket further comprises a tubular protruding piece protruding from one lateral side thereof around said horizontal bottom hole to protect said male knob member.

* * * * *